US005287928A

United States Patent [19]

Healy et al.

[11] Patent Number: 5,287,928

[45] Date of Patent: Feb. 22, 1994

[54] APPARATUS AND METHOD FOR REPAIRING A GRAVEL-PACKED WELL COMPLETION

[75] Inventors: John C. Healy, Metairie, La.; Richard A. Sukup, Burleson, Tex.

[73] Assignee: Mobil Oil Corporation, Fairfax, Va.

[21] Appl. No.: 976,023

[22] Filed: Nov. 13, 1992

[51] Int. Cl.[5] ..... E21B 43/00

[52] U.S. Cl. ..... 166/278; 166/297

[58] Field of Search ..... 166/278, 297-299, 166/55-55.1

[56] References Cited

U.S. PATENT DOCUMENTS

| | | | |
|---|---|---|---|
| 4,541,486 | 9/1985 | Wetzel et al. | 166/297 |
| 4,711,302 | 12/1987 | Jennings, Jr. | 166/250 |
| 4,964,464 | 10/1990 | Myers | 166/278 |
| 5,058,680 | 10/1991 | Huber et al. | 166/297 |

*Primary Examiner*—Thuy M. Bui

*Attorney, Agent, or Firm*—Alexander J. McKillop; George W. Hager, Jr.; Michael J. Mlotkowski

[57] ABSTRACT

An apparatus for repairing a well completion having a gravel-packed annulus formed by a liner and a well casing, the annulus having at least one region within the gravel pack which is devoid of gravel. The apparatus includes a tubular detonator sub pipe for placing an explosive device within, the sub pipe having a first end and a second end, the first end having a connector for connecting the sub pipe to a work string adapted to convey an electrical line; at least one elongated rigid member having a first end and a second end, the rigid member having a longitudinally disposed hole for placing an explosive primer cord therethrough, the rigid member having a plurality of vent orifices in fluid communication with the longitudinally disposed hole; and a pinned hinge for pivotally connecting the first end of the rigid member to the second end of the tubular detonator sub pipe; whereby detonation of the explosive device detonates the primer cord effecting pivotal movement of the at least one elongated rigid member so as to cause the apparatus to impact the liner wall of the gravel-packed well completion.

20 Claims, 3 Drawing Sheets

APPARATUS AND METHOD FOR REPAIRING A GRAVEL-PACKED WELL COMPLETION

FIELD OF THE INVENTION

The present invention relates generally to the use of gravel packs in subterranean wells and, more particularly, to an apparatus for repairing a gravel-packed well completion.

BACKGROUND OF THE INVENTION

In the production of formation fluids, including crude oils and other hydrocarbons, formation characteristics can have a substantial effect on the efficiency of production. Recovery of formation fluids is frequently difficult when the subterranean formation is comprised of one or more incompetent or unconsolidated sand layers or zones. Sand in the incompetent or unconsolidated sand zone can move or migrate into the well bore during the recovery of formation fluids from that zone. As is well known, the movement of sand into the well bore can cause the I well to cease production of reservoir fluids. Not only can fluid production be reduced or even stopped altogether if sand particles flow from the well to the surface, serious mechanical problems can result from the passage of abrasive sand particles through pumps and other mechanical devices.

A conventional technique for completing a well in an incompetent formation to substantially prevent entrainment of earth particles into the well involves running one or more strings of casing into the well bore and then running the actual production tubing inside the casing. At the wellsite, the casing is perforated across the productive zones of the reservoir to permit production fluids to enter the well bore. While it is possible to have an open face across the oil- or gas-bearing zone, it is such an arrangement which permits formation sand to be swept in to the well bore. To correct this problem, sand screening is usually employed in the region opposite the casing perforations. Packers may also be used above and below the sand screens to seal off the portion where production fluids flow in to the tubing from the rest of the annulus. The annulus around the screen is conventionally packed with relatively coarse sand or gravel to reduce the amount of formation sand reaching the screen. A work string is used to spot the gravel around the screen, as those skilled in the art readily recognize. The gravel can be hydraulically placed in the annular void space by circulating a suspension of the gravel in water or some other liquid through the void space so that the gravel is deposited therein.

Ideally, the gravel so placed should fill the annulus between the sand screen and the casing. Unfortunately, voids often remain within the annulus which are not filled with gravel. If uncorrected, these voids will eventually become filled with accumulated formation sand, forming sand plugs or bridges. In practice, a number of such bridges may occur, particularly over long intervals. Voids and sand bridges greatly reduce the effectiveness of the gravel pack by permitting the formation sand to migrate into the production flowpath, resulting in the problems previously described. Moreover, voids in the gravel packed interval commonly allow the incompetent formation sand to flow against the sand screen, resulting in "sand-cutting"of the screen, ultimately leading to a complete failure of gravel pack.

A variety of tools and processes have been developed to minimize the occurrence of voids and sand bridges in the gravel pack. One such conventional process employs a washing tool to wash the perforations in casing and sand control screens. By establishing flow at relatively high pressures, such tools can often open a void in the gravel packing or dislodge a sand bridge. One such tool is commonly referred to as a swab cup straddle-type tool. Such tools create hydraulic turbulence to dislodge sand bridges. Another type of device is disclosed in U.S. Pat. No. 4,711,302, issued to Jennings. This device utilizes a high energy impulse to remove void spaces in an in-casing-type gravel pack. In practice, the device is placed in close proximity to a void space and detonated. Upon detonation, the device generates a level of energy sufficient to create turbulence and agitation of the gravel within the gravel pack. The level of turbulence is said to be sufficient to readjust and consolidate the gravel within the pack.

U.S. Pat. No. 4,964,464, issued to Myers, discloses an anti-sand bridge tool for use in dislodging a sand bridge between a liner wall and a casing wall of a gravel packed well completion. The tool includes a tubular sub pipe having a first end and a second end, the first end having means for connecting the tubular sub pipe to a tubular work string, a hollow flexible member for delivering a fluid at high pressure having a first end and a second end, the first end of the flexible member adapted for attachment to the second end of the tubular sub pipe, and a striking means having a fluid inlet orifice and at least one fluid exit orifice, the fluid inlet orifice connected to and in fluid communication with the second end of the flexible member. In operation, the initiation of fluid flow through the tool effects an arcuate movement of the striking means resulting in the striking means contacting the liner wall and dislodging the sand bridge.

Although the aforementioned tools and processes may be effective in the removal of gravel pack voids and sand bridges, a need still exists for a tool which can deliver a localized force effective to eliminate gravel pack voids or dislodge sand bridges within a gravel packed well completion.

SUMMARY OF THE INVENTION

In accordance with the present invention there is provided an apparatus for repairing a well completion having a gravel-packed annulus formed by a liner and a well casing, the annulus having at least one region within the gravel pack which is devoid of gravel. The apparatus includes a tubular detonator sub pipe for placing an explosive device within, the sub pipe having a first end and a second end, the first end having means for connecting the sub pipe to an electrical line for conveyance purposes; at least one elongated rigid member having a first end and a second end, the rigid member having a longitudinally disposed hole for placing an explosive primer cord therethrough, the rigid member having a plurality of vent orifices in fluid communication with the longitudinally disposed hole; and means for pivotally connecting the first end of the rigid member to the second end of the tubular detonator sub pipe; whereby detonation of the explosive device detonates the primer cord effecting pivotal movement of the at least one elongated rigid member so as to cause the apparatus to impact the liner wall of the gravel-packed well completion.

Also provided is a method for repairing a well completion having a gravel-packed annulus formed by a liner and a well casing, the annulus having at least one region within the gravel pack which is devoid of gravel, comprising the steps of: (a) locating the region within the gravel pack which is devoid of gravel; (b) positioning a tool for eliminating a voided region within a gravel-packed completion, the tool comprising: a tubular detonator sub pipe for placing an explosive device within, the sub pipe having a first end and a second end, the first end having means for connecting the sub pipe to a work string adapted to convey an electrical line; at least one elongated rigid member having a first end and a second end, the rigid member having a longitudinally disposed hole for placing an explosive primer cord therethrough, the rigid member having a plurality of vent orifices in fluid communication with the longitudinally disposed hole; and means for pivotally connecting the first end of the rigid member to the second end of the tubular detonator sub pipe; (c) detonating the explosive device; and (d) detonating the primer cord to effect pivotal movement of the at least one elongated rigid member so as to cause the tool to impact the liner wall of the gravel-packed well completion.

It is therefore an object of the present invention to provide an effective and novel tool to eliminate gravel pack voids and/or sand bridges from gravel packed well completions used in the production of fluids from a subterranean formation.

It is another object of the present invention to provide a method for eliminating voids and dislodging sand bridges from gravel packs.

It is a further object of the present invention to provide a tool and method for eliminating voids and dislodging sand bridges from gravel packs which has utility in both vertical and horizontal well applications.

It is yet another object of the present invention to provide a tool to eliminate gravel-pack voids and/or dislodge sand bridges from gravel-packed well completions which utilizes a combination of localized mechanical impact forces, forces generated by acoustical wave fronts and hydraulic forces to effect the eliminating of voids and/or the dislodging of sand bridges.

Other objects, aspects and the several advantages of the present invention will become apparent to those skilled in the art upon a reading of the specification and the claims appended thereto.

DETAILED DESCRIPTION OF THE INVENTION

Figure 1:
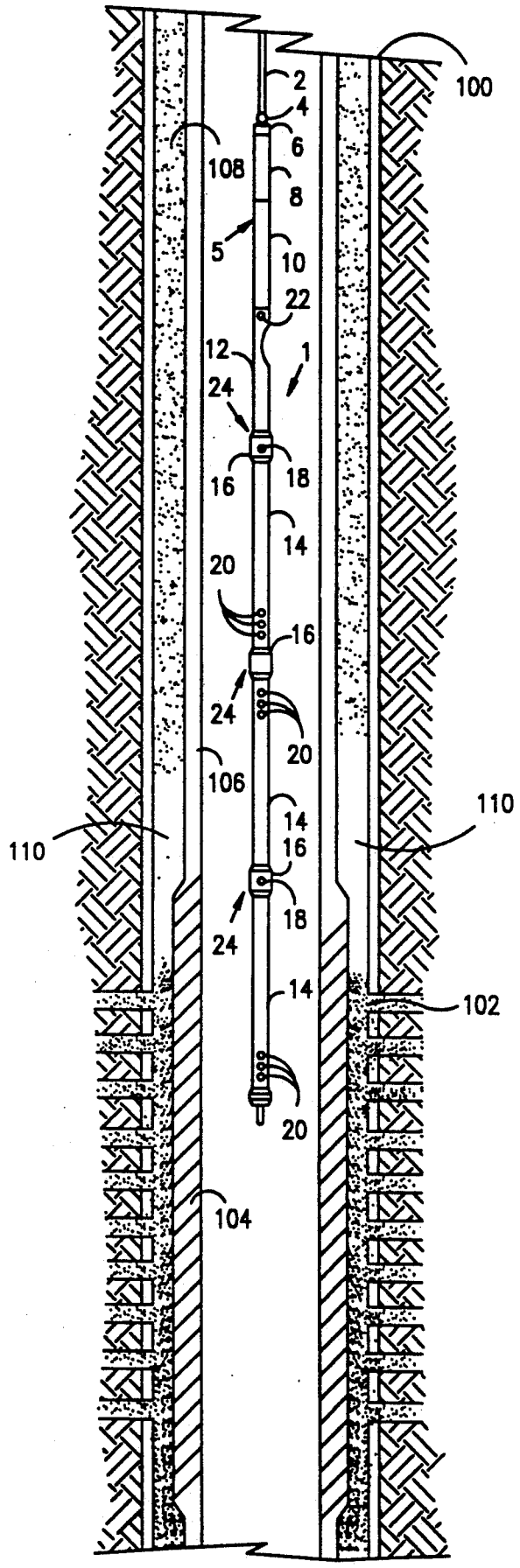
FIG. 1 is a longitudinal cross-sectional view of a gravel-packed well completion having a void within the gravel pack. An apparatus for eliminating such a void, in accordance with the present invention, is located within the liner, near the voided region.

The actual configuration, use and the several advantages of the present invention will be understood by referring to the drawings in which like numerals identify like elements. While this invention is susceptible of embodiment in many different forms, there is shown in detail a specific embodiment which is to be considered as an exemplification of the principles of the invention and not intended to limit the invention.

Referring now to FIG. 1, a longitudinal cross-sectional view of a gravel-packed well completion having a void within the gravel pack is shown. The arrangement shown is conventional, as those skilled in the art will plainly recognize. Casing 100 is shown within the well bore and is cemented in place in the usual manner. Casing 100 has perforations 102 located circumferentially in the producing zone of the well. Wire wrapped sand screen 104 is located in the region where the casing perforations are located, consistent with common practice. Blank liner 106 is located above wire wrapped screen 104 in the non-producing zone. In the annular region between casing wall 100 and the combination of wire wrapped screen 104 and blank liner 106 is a gravel pack 108. As may be seen, an annular voided region 110 is shown to be present within gravel pack 108.

Shown within the well bore is a tool 1 for repairing a gravel-packed well completion having a region which is devoid gravel, in accordance with the present invention. The tool includes, in its essential elements, a tubular detonator sub pipe 12 for placing an explosive device within, detonator sub pipe 12 having a first end and a second end, the first end having means for connecting detonator sub pipe 22 to a work string section 5, adapted to convey an electrical line 2. The work string section 5 is shown to include firing head 10 having a second end connected to detonator sub pipe 12 by connecting means 7, the first end of firing head 10 connected to the second end of sub pipe 8. The first end of sub pipe 8 is connected to logging head adapter 6. Logging head adapter 6 is connected to cable head adapter 4, cable head adapter 4 being adapted to convey electrical conductor 2 through the work string section 5 to the electro-explosive device (EED or detonator) which is contained within the firing head 10.

Figure 2:
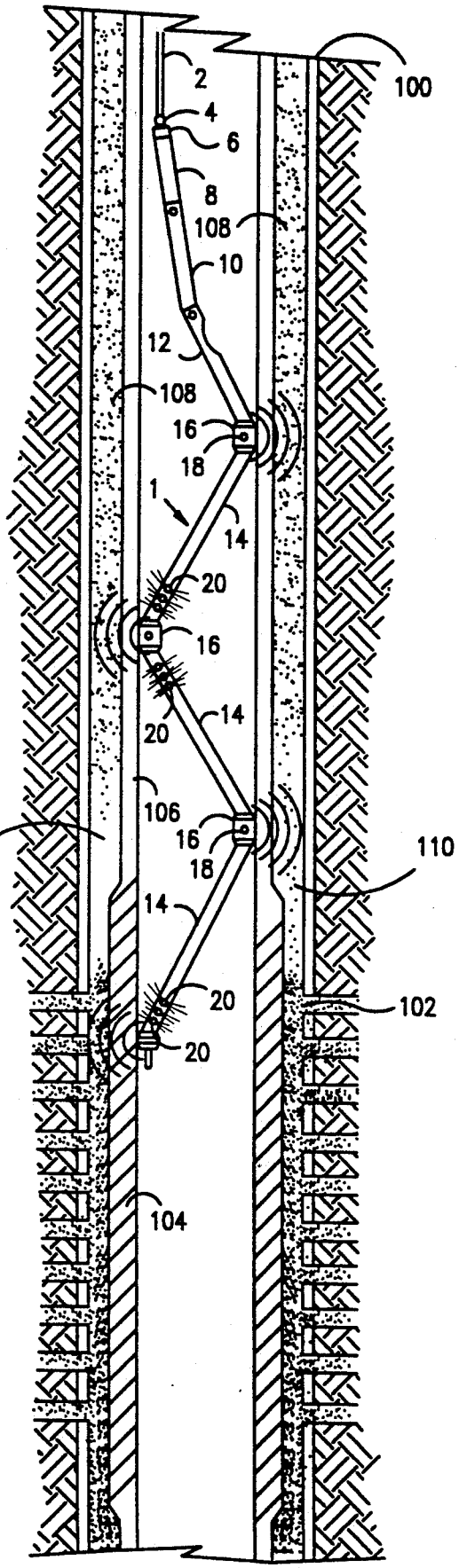
FIG. 2 shows the FIG. 1 well completion at a point in time following detonation of the explosive device and primer cord of the apparatus of the present invention, the detonation effecting pivotal movement causing the apparatus to impact the liner wall of the gravel-packed well completion.
Figure 4A:
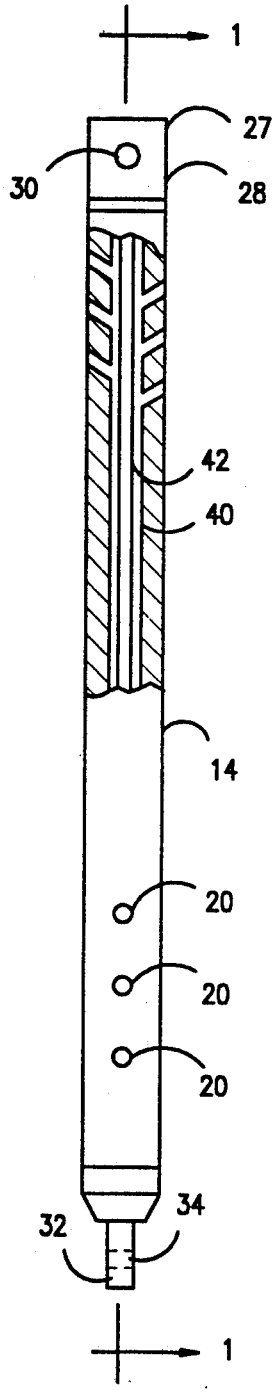
FIGS. 4A and 4B depict an elongated member of the apparatus of the present invention, in partial cross-section.
Figure 4B:
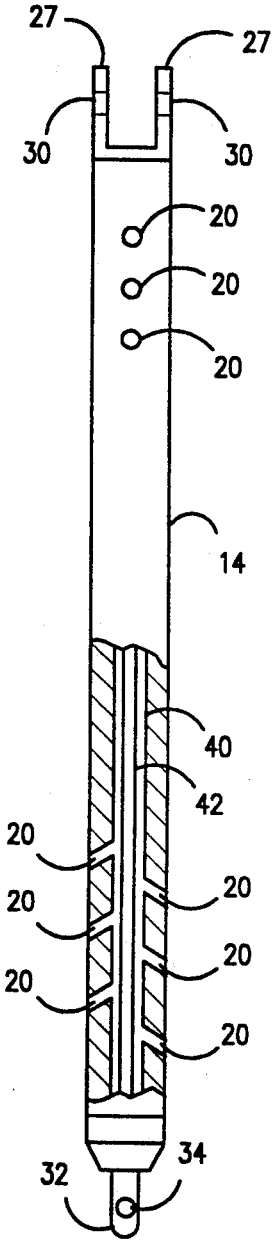

Still referring to FIG. 1, tool 1 is shown to also include at least one elongated rigid member 14 having a first end and a second end, rigid member 14 having a longitudinally disposed hole 40 for placing an explosive primer cord 42 therethrough (see FIGS. 4A and 4*b*). Rigid member 14 also includes a plurality of vent orifices 20 in fluid communication with longitudinally disposed hole 40. To permit the pivotal movement of rigid member 14, rigid member 14 includes a means for pivotally connecting the first end of rigid member 14 to the second end of tubular detonator sub pipe 12 or to the second end of a second rigid member 14. This advantageous configuration permits, upon detonation of the electro-explosive device which then detonates explosive primer cord 42, the pivotal movement of elongated rigid member 14 which causes portions of tool 1 to impact liner walls 104 and/or 106 of the gravel-packed well completion (see FIG. 2), as will be described in more detail below.

Figure 3:
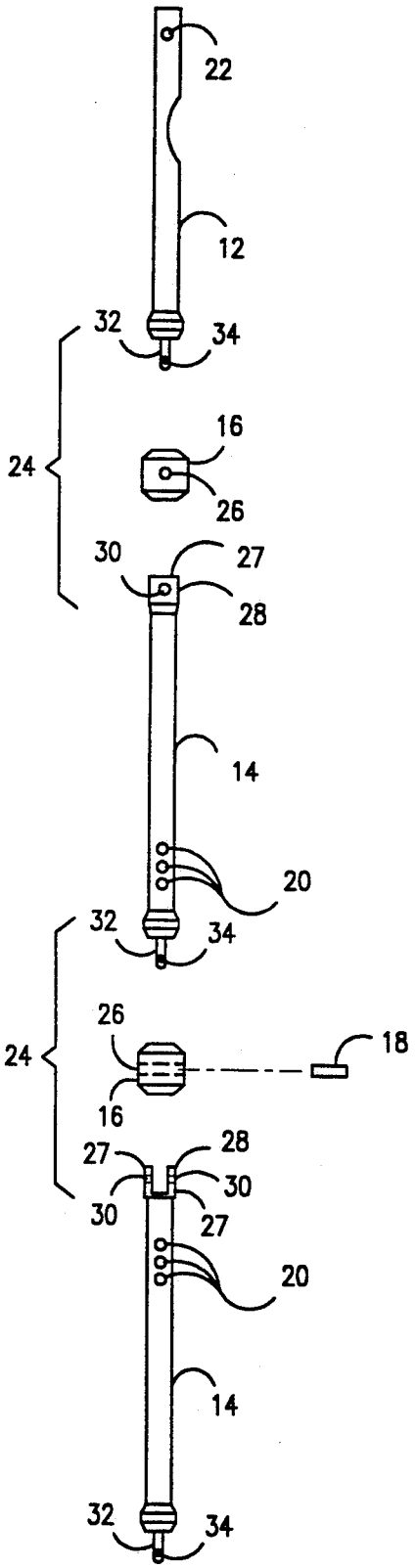
FIG. 3 is an exploded view of the apparatus of the present invention.

A preferred means for pivotally connecting the first end of rigid member 14 to the second end of the tubular detonator sub pipe 12 is shown in FIG. 3, which presents an exploded view of the apparatus of the present invention. The preferred pivotal connecting means is a pinned hinge assembly 25 which includes a fork 28 integrally joined to the first end of rigid member 14, fork 28 having a pair of spaced-apart tine members 27, each tine member 27 having a hole 30 therethrough, the holes 30 being axially aligned. Fork member 28, as is preferred, is configured to accept a blade member 32. Blade member 32 is integrally connected to the second end of detonator sub pipe 12. Likewise, an identically configured blade member 32 can be integrally connected to the second end of rigid member 14 to enable a plurality of rigid members 14 to be pivotally connected in an end-to-end arrangement, to enable the length of tool 1 to be tailored on the basis of need. Blade member 32, itself, has a hole 34 therethrough, hole 34 enabling the alignment of same with holes 30 of fork 28, when tool 1 is assembled.

Still referring to FIG. 3, as is particularly preferred, a tubular collar 16 is employed to encase fork 28 and blade member 32. Tubular collar 16 has a hole 26 perpendicular to its axis and capable of alignment with hole 34 of blade member 32 and holes 30 of fork 28, when pinned hinge assembly 25 is assembled. As shown in FIG. 3, pin 18 is used to align and assemble fork 28, blade member 32 and collar 16 and allows the pivotal movement of the components of the present invention. As may be appreciated by reference to FIG. 2, collar 16 also serves as a striking means for contacting the liner wall, as shown. Such mechanical contact, in conjunction with the hydraulic force generated by the exhausted detonation gases emanating from vent orifices 20, as well as the acoustic force generated by the detonation wave front, is effective in eliminating voids in gravel packs.

Reference is now made to FIGS. 4A and 4B which depict elongated member 14 of tool 1, in partial cross-section. As shown, rigid member 14 has a axially aligned, longitudinally disposed hole 40 along its length for placing a conventional explosive primer cord 42 within. A plurality of vent orifices 20 are in fluid communication with longitudinally disposed hole 40 to permit exhausted detonation gases to emanate therefrom. The force generated from the detonation gases exiting orifices 20, together with the acoustic force generated by the detonation wave front, cause the pivotal movement of rigid member 14, relative to the other components of tool 1, as those skilled in the art can readily recognize. Vent orifices 20 are strategically placed to enhance the pivotal movement of rigid member 14, with a particularly preferred arrangement depicted in FIGS. 4A and 4B.

Reference will again be made to FIG. 2 to provide illustration concerning the method of use of tool 1 of the present invention. To utilize tool 1, it is essential that the approximate locations of any sand bridges or gravel pack voids be determined. This can be accomplished through the use of any of the well known downhole logging techniques designed to accomplish such a task, as those skilled in the art will readily recognize. Following the determination of the relative location of a void or sand bridge, tool 1 is coupled to a tubular work string capable of conveying an electrical line. Tool 1 is then lowered into the well bore to a point where a tubular collar 16 is adjacent to void 110. Following the proper placement tool 1, the electro-explosive device (EED) is detonated which then detonates the explosive primer cord 42 causing the pivotal movement of each of the three elongated rigid members 14 shown in FIG. 2 which causes the collars 16 of tool 1 to impact liner walls 104 and 106 of the gravel-packed well completion, thus, together with the hydraulic force generated from the detonation gases exiting orifices 20, and the acoustic force generated by the detonation wave front, causing the gravel to fall, as shown, substantially eliminating the voided region 110.

As may be appreciated, it is the exhausting of the detonation gases through angularly disposed orifices 20 which creates the angular momentum which aids in initiating the arcuate, pivotal movement of each rigid member 14 causing collars 16 to contact the blank liner wall 106 or screen 104. As can be appreciated, the higher the explosive load placed within the tool 1, the higher the forces generated by the detonation of that load and the greater the force of impact will be. For example, if a conventional 80 gram/foot primer cord is used within a rigid member 14 having a length of 10 feet, an 800 gram load will have been charged to that rigid member 14. The gas which such an explosive load will generate is on the order of 600,000 $cm^3$, within a residual volume of 100 $cm^3$. Detonating such a load would produce a residual pressure of approximately 6000 atmospheres, or 88,200 psi.

As will be readily apparent to those skilled in the art, the tool and method for eliminating voids and dislodging sand bridges from gravel packs of the present invention has utility in both vertical and horizontal well applications, although it has been depicted primarily in a vertical well setting for illustrative purposes.

Although the present invention has been described with preferred embodiments, it is to be understood that modifications and variations may be made without departing from the spirit and scope of this invention, as those skilled in the art will readily understand. Such modifications and variations are considered to be within the purview and scope of the appended claims.

What is claimed is:

1. An apparatus for repairing a well completion having a gravel-packed annulus formed by a liner and a well casing, the annulus having at least one region within the gravel pack which is devoid of gravel, comprising:

(a) a tubular detonator sub pipe for placing an explosive device within, said sub pipe having a first end and a second end, said first end having means for connecting said sub pipe to a work string adapted to convey an electrical line;

(b) at least one elongated rigid member having a first end and a second end, said rigid member having a longitudinally disposed hole for placing an explosive primer cord therethrough, said rigid member having a plurality of vent orifices in fluid communication with said longitudinally disposed hole; and (c) means for pivotally connecting said first end of said rigid member to said second end of said tubular detonator sub pipe;

whereby detonation of the explosive device detonates the primer cord effecting pivotal movement of said at least one elongated rigid member so as to cause the apparatus to impact the liner wall of the gravel-packed well completion.

2. The apparatus of claim 1, wherein said second end of said elongated rigid member further includes means for pivotally connecting a first end of a second rigid member.

3. The apparatus of claim 2, further comprising a second elongated rigid member pivotally connected to said second end of said elongated rigid member.

4. The apparatus of claim 1, wherein said means for pivotally connecting said first end of said rigid member to said second end of said tubular detonator sub pipe is a pinned hinge comprising a fork and blade arrangement.

5. The apparatus of claim 4, wherein said pinned hinge further comprises a tubular collar to encase said fork and blade arrangement.

6. The apparatus of claim 4, wherein said means for pivotally connecting said first end of said second rigid member to said second end of said at least one rigid member is a pinned hinge comprising a fork and blade arrangement.

7. The apparatus of claim 6, wherein said pinned hinge for pivotally connecting said first end of said second rigid member to said second end of said at least one rigid member further comprises a tubular collar-to encase said fork and blade arrangement.

8. The apparatus of claim 7, further comprising a tubular firing head having a first end and a second end, said second end connected to said first end of said detonator sub pipe.

9. The apparatus of claim 1, further comprising a tubular firing head having a first end and a second end, said second end connected to said first end of said detonator sub pipe.

10. The apparatus of claim 1, wherein said at least one rigid member is produced from steel.

11. A method for repairing a well completion having a gravel-packed annulus formed by a liner and a well casing, the annulus having at least one region within the gravel pack which is devoid of gravel, comprising the steps of:

(a) locating the region within the gravel pack which is devoid of gravel;

(b) positioning a tool for eliminating a voided region within a gravel-packed completion, the tool comprising: a tubular detonator sub pipe for placing an explosive device within, the sub pipe having a first end and a second end, the first end having means for connecting the sub pipe to a work string adapted to convey an electrical line; at least one elongated rigid member having a first end and a second end, the rigid member having a longitudinally disposed hole for placing an explosive primer cord therethrough, the rigid member having a plurality of vent orifices in fluid communication with the longitudinally disposed hole; and means for pivotally connecting the first end of the rigid member to the second end of the tubular detonator sub pipe;

(c) detonating the explosive device; and (d) detonating the primer cord to effect pivotal movement of the at least one elongated rigid member so as to cause the tool to impact the liner wall of the gravel-packed well completion.

12. The method of claim 11, wherein the second end of the elongated rigid member of the tool positioned in step (b) further includes means for pivotally connecting a first end of a second rigid member.

13. The method of claim 12, wherein the tool positioned in step (b) further comprises a second elongated rigid member pivotally connected to the second end of the elongated rigid member.

14. The method of claim 11, wherein the means for pivotally connecting the first end of the rigid member to the second end of the tubular detonator sub pipe of the tool positioned in step (b) is a pinned hinge comprising a fork and blade arrangement.

15. The method of claim 14, wherein the pinned hinge of the tool positioned in step (b) further comprises a tubular collar to encase the fork and blade arrangement.

16. The method of claim 14, wherein the means for pivotally connecting the first end of the second rigid member to the second end of the at least one rigid member of the tool positioned in step (b) is a pinned hinge comprising a fork and blade arrangement.

17. The method of claim 16, wherein the pinned hinge for pivotally connecting the first end of the second rigid member to the second end of the at least one rigid member of the tool positioned in step (b) further comprises a tubular collar to encase the fork and blade arrangement.

18. The method of claim 17, wherein the tool positioned in step (b) further comprises a tubular firing head having a first end and a second end, the second end connected to the first end of the detonator sub pipe.

19. The method of claim 11, wherein the tool positioned in step (b) further comprises a tubular firing head having a first end and a second end, the second end connected to the first lend of the detonator sub pipe.

20. The method of claim 11, wherein the at least one rigid member of the tool positioned in step (b) is produced from steel.

* * * * *